United States Patent [19]

Thuries

[11] 4,443,779

[45] Apr. 17, 1984

[54] CURRENT TRANSFORMER

[75] Inventor: Edmond Thuries, Meyzieu, France

[73] Assignee: Alsthom-Atlantique, Paris, France

[21] Appl. No.: 313,401

[22] Filed: Oct. 21, 1981

[30] Foreign Application Priority Data

Oct. 22, 1980 [FR] France ..... 80 22552

[51] Int. Cl.[3] ..... H01F 27/04

[52] U.S. Cl. ..... 336/92; 336/174; 336/195

[58] Field of Search ..... 336/174, 175, 173, 176, 336/62, 192, 90, 105, 92, 195, 94, 107

[56] References Cited

U.S. PATENT DOCUMENTS 2,804,577 8/1957 Roth ..... 336/174 X R
2,947,958 8/1960 Marks ..... 336/90 X R

FOREIGN PATENT DOCUMENTS 276256 11/1965 Australia ..... 336/175
582095 8/1959 Canada ..... 336/174
1289299 5/1961 France ..... 336/174
2467473 10/1979 France ..... 336/174

*Primary Examiner*—Thomas J. Kozma
*Attorney, Agent, or Firm*—Sughrue, Mion, Zinn, Macpeak & Seas

[57] ABSTRACT

A current transformer for very high tension units. The transformer has an insulating through bushing and an annular metal chamber both filled with compressed gas, a primary circuit with an input conductor which enters the chamber via the through bushing and an output conductor which leaves the chamber via the through bushing coaxially to the first conductor, and at least two magnetic circuits each having a secondary winding, wherein the current transformer has an electric side connection at the lower portion (21) of the metal chamber (11) and wherein the magnetic circuits (14, 15) are disposed on either side of said side connection.

3 Claims, 8 Drawing Figures

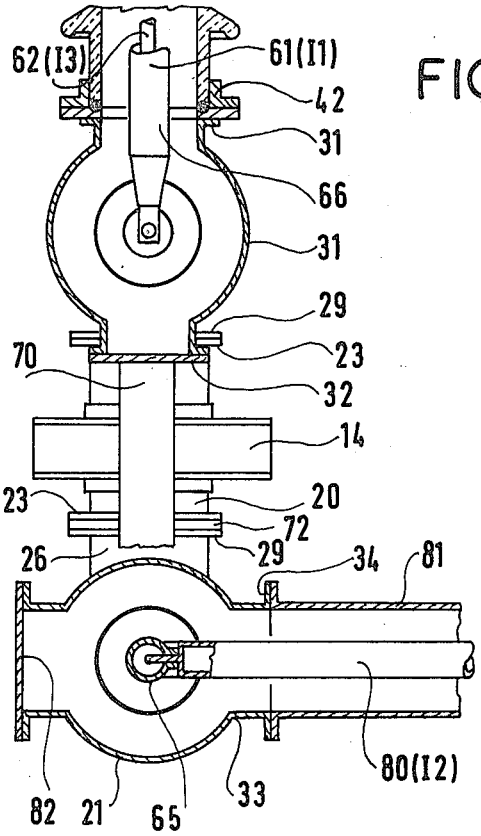
FIG.4
FIG.5
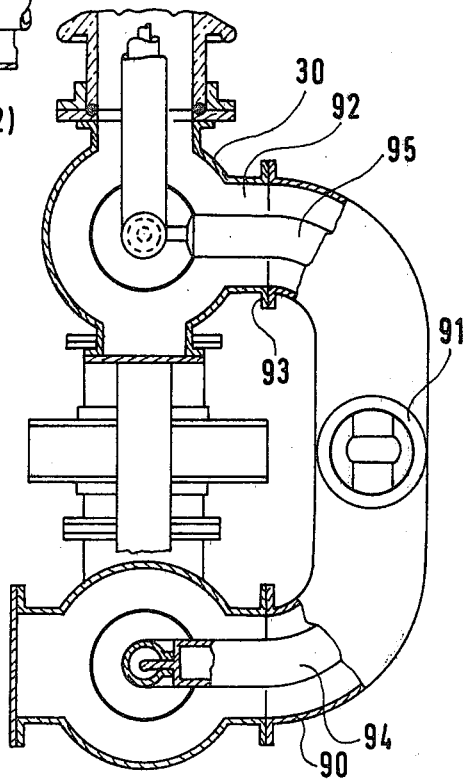

CURRENT TRANSFORMER

IDENTIFICATION OF RELATED APPLICATION

The subject matter of this application relates to that of application Ser. No. 194,744, now U.S. Pat. No. 4,320,372, filed Oct. 7, 1980, entitled "A CURRENT TRANSFORMER FOR A HIGH-TENSION INSTALLATION" by inventors Edmond Thuries, Jean-Paul Sadoulet and Alain Sanchez.

The invention relates to current transformers used in very high tension installations.

BACKGROUND OF THE INVENTION

In some very high tension units such as the one outlined in FIG. 1, there are outgoing conductors 3 and 4 between a first set of bars 1 and a second set of bars 2, conductors 3 and 4 being protected by circuit-breakers 5, 6 and 7.

The outgoing conductors are surrounded by current transformers such as 8 and 9 for outgoing conductor 3 and 10 and 11 for outgoing conductor 4. The outgoing conductors can be either cable terminals such as the one referenced 3A in FIG. 2 which illustrates an embodiment of the portion G encircled in FIG. 1, or an aerial conductor which, like the one referenced 3B and illustrated by broken lines, runs vertically to the link line between the two transformers 8 and 9 and then runs parallel to the link line.

For a three-phase unit and a plurality of outgoing and in-coming conductors, this disposition occupies a great deal of space, either vertically or horizontally. Now, there is an increasing demand for very high tension electric units which are as compact as possible with respect to surface area and volume.

In current transformers the most expensive and least compact part with respect to floor area is the insulation.

Preferred embodiments of the invention provide measuring apparatus which performs the functions of two current transformers in the form of a single unit for insulation from the earth.

SUMMARY OF THE INVENTION

The invention provides a current transformers with an insulating through bushing and an annular metal chamber both filled with compressed gas, a primary circuit with an input conductor which enters the chamber via the through bushing and an output conductor which leaves the chamber via the through bushing coaxially to the first conductor, and at least two magnetic circuits each having a secondary winding, wherein the current transformer has an electric side connection at the lower portion of the metal chamber and wherein the magnetic circuits are disposed on either side of said side connection.

BRIEF DESCRIPTION OF THE DRAWINGS

Embodiments of the are described by way of example with reference to the accompanying drawings in which:

FIG. 4 illustrates a partial side cross-section of the lower portion of the same transformer;

FIG. 5 is a variant of FIG. 4 in which the insulation of the transformer is used for the outgoing conductor;

DESCRIPTION OF PREFERRED EMBODIMENTS

Figure 1:
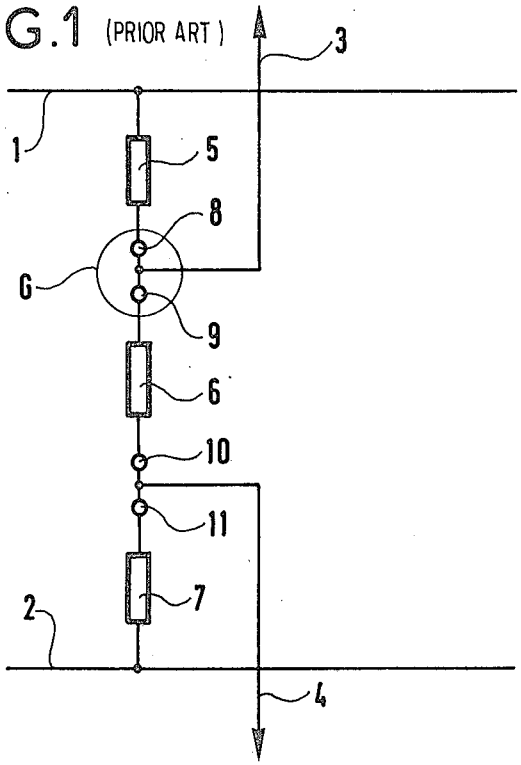
FIG. 1 (PRIOR ART)
FIGS. 1 and 2 are partial schematic illustrations of prior art high-tension units.
Figure 2:
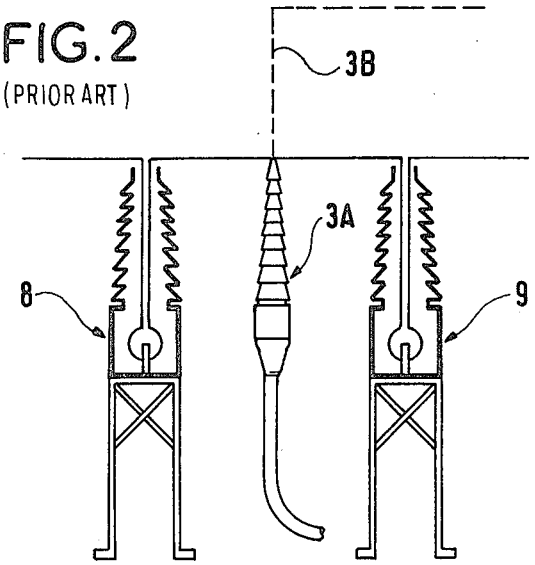
FIG. 2 (PRIOR ART)
Figure 3:
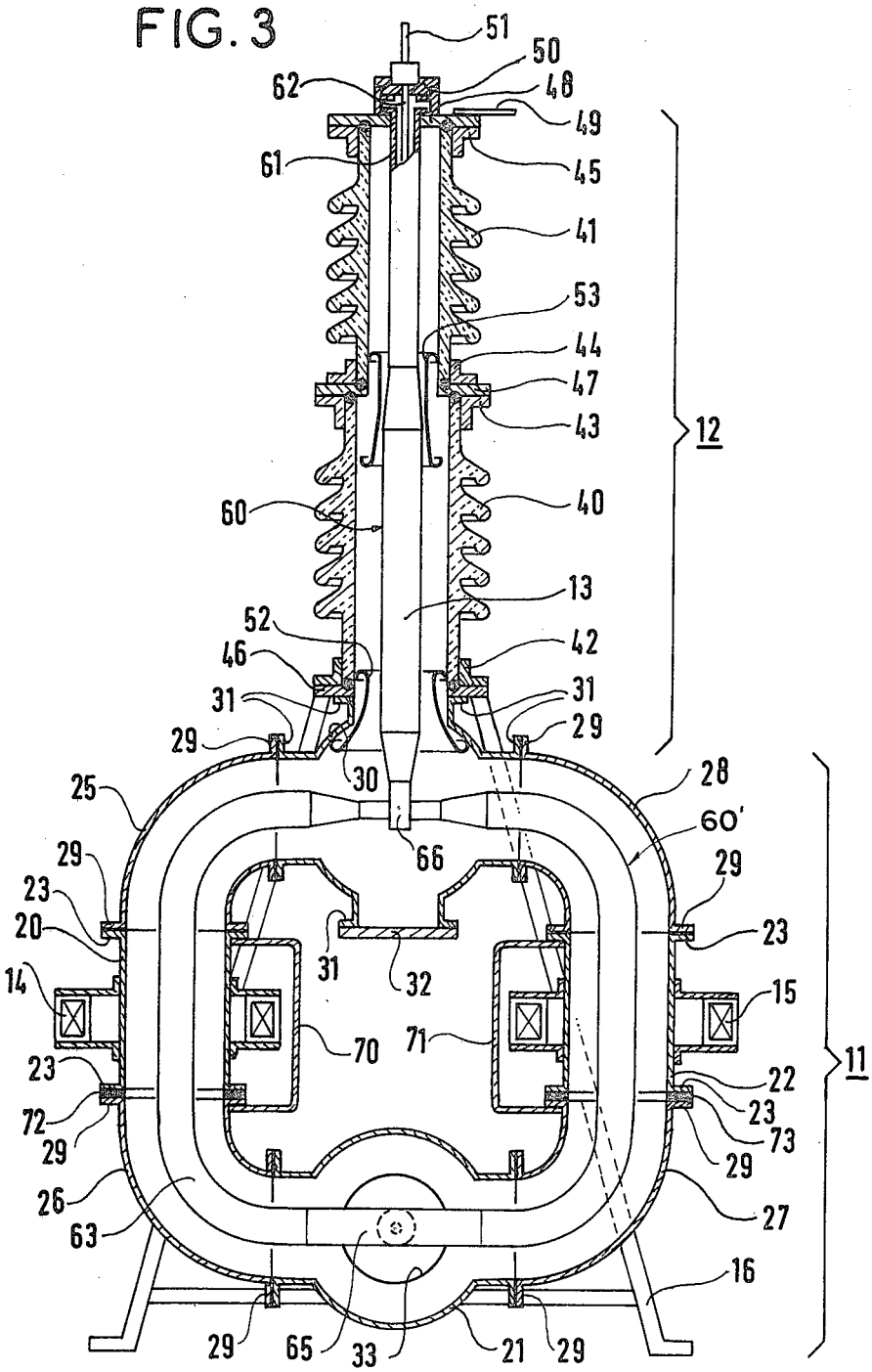
FIG. 3 is a partial vertical cross-section of a current transformer in accordance with a first embodiment of the invention.

Many components of the transformer illustrated in FIG. 3 are analogous to those described in published French patent application No. FR A2,467,473 dated Oct. 14th, 1979.

The current transformer has a chamber filled with compressed gas, e.g. sulphur hexafluoride; this chamber has a metal portion 12*a* and an insulating through bushing 12, a primary conductor 13 and two magnetic circuits 14 and 15 with secondary windings; the assembly thus formed is supported by a frame 16.

The metal chamber is made of aluminium alloy and is constituted by straight cylindrical tubes such as 20 and 22 ending in flanges 23, by toroidal tubes 25, 26, 27, 28 (a quarter-torus each) also fitted with flanges 29 at their ends, by a lower tube 21 and by a spherical cross-shaped metal connection component 30 whose four openings end in flanges 31; one of these openings is used as an inspection port and is closed by a plate 32.

The spherical lower tube 21 has a side connection 33 which runs horizontally as illustrated in FIG. 4. The side duct ends in a flange 34. When assembled the tubes are sealed together by seals accommodated in the various flanges 29.

The insulating through bushing 12 is formed by two superimposed ceramic components 40 and 41 on which flanges 42, 43, 44, 45 are fixed; the metal chamber 12*a* is connected by a plate 46 to the flange 42 of the lower ceramic component 40. Likewise, a plate 47 connects the two ceramic components together; a plate 48 serves as a cover for the upper ceramic component. It has a first current collector 49 and a second current collector 51 insulated form the first by an insulator 50.

Glow discharge screens 52 and 53 are placed level with plates 46 and 47.

Figure 6:
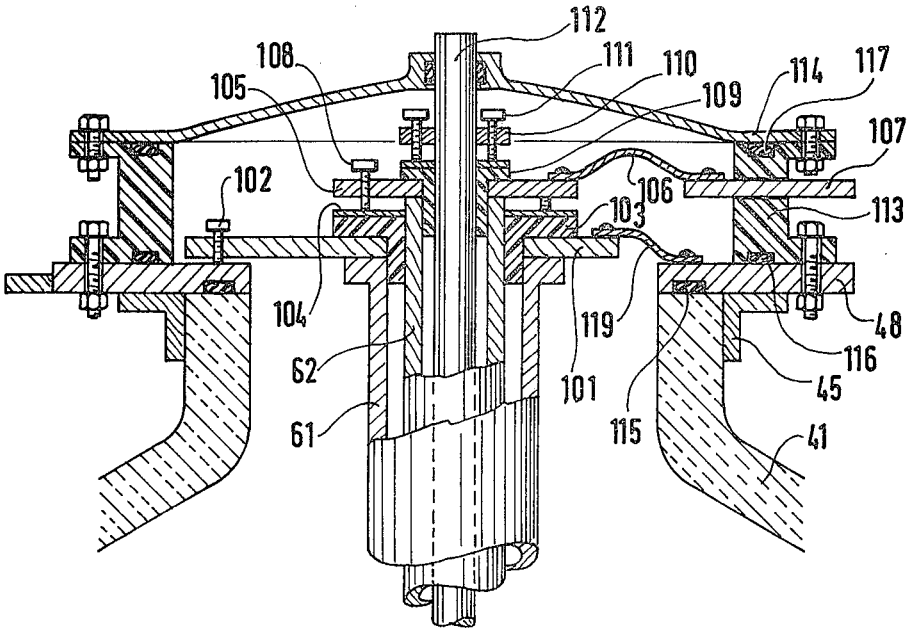
FIG. 6 is a detailed cross-section of the upper portion of the embodiment of the transformer illustrated in FIG. 5.

The primary conductor has a rectilinear portion 60 and a ring-shaped portion indicated generally at 60'. The rectilinear portion 60 is constituted by two coaxial conductors 61 and 62, conductor 61 being electrically connected to plate 48 and to current collector 49, the other conductor 62 being electrically connected to current collector 51. The ring-shaped portion 60' has two U-shaped parts 63 and 64 and two T-shaped parts—a bottom one 65 and a top one 66. The ring-shaped part 60' is made of a tubular conductive substance; some of the T-shaped part 66 is conical so that the left-hand portion of the ring-shaped part 60' can be more easily connected to the outer rectilinear conductor 61 and that the right-hand portion 63 of the ring-shaped part 60' can be more easily connected to the inner rectilinear conductor 62; the conductors 61 and 62 are not at very different electric potentials (voltage drop along the ring-shaped part) and a solid insulator 109 as illustrated in FIG. 6 is sufficient.

Each of the tubes 20 and 22 carries a respective magnetic circuit and their secondary windings 14 and 15 which constitute different measuring circuits, the primary conductors not necessarily having the same current flowing through them since power can be tapped at the bottom T-shaped part 65.

The shape of the U-shaped conductive parts allows them to pass through the tubes 25, 26, 27, 28 of quarter-torus cross-section and through the cylindrical tubes 20 and 22; these U-shaped parts fit together and lock into the T-shaped parts 65 and 66.

It is obvious that a plurality of magnetic circuits and their secondary windings could be placed on each tube 20 and 22.

The tubes 20 and 22 are made of non-magnetic substance and the current which flows in the metal chamber 11 is shunted around the tubes 20 and 22 by shunt lines 70 and 71; insulating rings 72 and 73 galvanically insulate the flanges 23 and 29 beneath the tubes 20 and 22 from each other.

A current I1 enters via the current collector 49, flows along the rectilinear outer conductor 61 and the U-shaped part 63 and is divided into two currents I2 and I3; from the T-shaped part 65 onwards, conductor 80 housed in tube 81 which forms a gas insulated cable and which, for example, is connected to a unit in a metal casing filled with compressed gas.

This tube 81 is connected to the tube 21 by a flange 34.

The current I3 flows along the third branch line of the T-shaped part 65, the U-shaped part 64, the rectilinear central conductor 62 located in the T-shaped part 66 and being coaxial with the conductor 61 and lastly the current collector 51. The transformer is thus a double transformer. This saves one insulating through-bushing and the space corresponding thereto. The ring-shaped primary conductor is suspended inside the metal chamber 12*a* as set forth in published French patent application No. FR-A2; 467, 473 and it is centred by moving the rectilinear portion 60 upwards, the position being checked via the inspection port 32 or via the opening provided for the conductor 80 to pass through or, possibly, via an inspection port such as 82 in the tube 21 on the opposite side to the opening for the conductor 80 to pass through.

Figure 7:
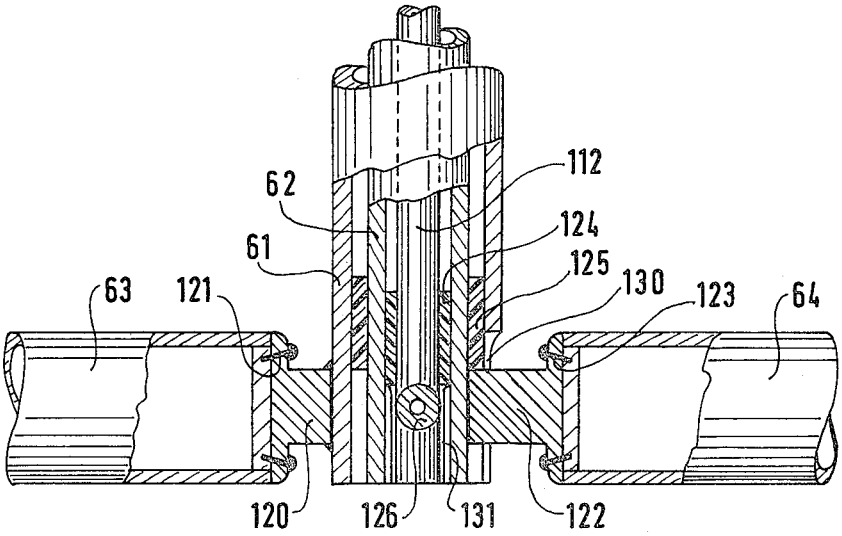
FIG. 7 is a detailed cross-section of the middle conductive portion of the transformer shown in FIG. 5.

The side connection could be aerial in which case the same transformer through-bushing may be used for three coaxial conductors instead of two. FIGS. 5, 6 and 7 illustrate this variant.

In FIG. 5, the tube 81 is replaced by a U-shaped tube 90 with an inspection hole 91, open, in the illustration, in its middle.

The cross-shaped connection component 30 has an opening 92 with a connection flange 93. The central conductor is in two parts 94 and 95 connected together at the inspection hole to form a U-shaped part.

Also, a single U-shaped conductor and a tube 90 in two parts can be used, an inspection hole being provided to check the centering of the conductor.

FIG. 6 shows how the three conductors are connected at the upper level of the current transformer and FIG. 7 shows how they are connected at the cross-shaped connection component.

The inside diameter of the plate 48 (FIG. 6) is almost the same as the diameter of the ceramic component 41; a plate 101 has three arms at an angle of 120° to one another with centering studs and jacks 102 to position all the conductors as a whole in the insulating chamber 12 and in the metal chamber 12*a;* metal braiding or foil 119 allows the current to pass between the plate 101 and the plate 48; the outer conductor 61 is mechanically fixed and electrically connected to the plate 101.

The conductor 62 is coaxial with the conductor 61 from which it is insulated by a ring 103 whose outer edge bears against the plate 101. This conductor 62 is mechanically and electrically connected to a plate 105 which, like the plate 101, has three arms to allow the height of the conductor 62 to be set by means of jacks 108; the jacks bear against a metal washer 104. A third conductor 112 is coaxial with and insulated from the preceding one by a ring 109 similar to 103 but has a diameter adapted to the dimensions of the conductors; jacks 111 which bear against a metal washer 110 also allow the height of a conductor 112 to be adjusted.

The plate 105 is connected by metal braiding or foil 106 to a current collector 107 embedded in a moulded insulating cylinder 113 fixed by threaded rods or bolts onto the plate 48 and a metal cap 114 on the insulator cylinder 113 which metal cap 114 has a sealed duct at its upper part for the conductor 112 and radially oblong holes at its periphery for fixing it without giving rise to stresses in the conductors 112, 62 and 61. Seals 115, 116, 117, 118 prevent leakage of the gas under pressure which fills the chamber.

FIG. 7 shows how the straight conductors are connected to the conductors of the ring-shaped portion and how the straight conductors are insulated from one another, connection and insulation being illustrated at the cross-shaped connection component 30. A connection 120 which is clamped e.g. by bolts 121 on the conductor 63 of the ring-shaped portion is brazed or welded onto the conductor 61 which has a notch 130 on the furthest end from the connection 120.

Likewise, a connection 122 is fixed onto the lower end of the conductor 62 which is clamped on the conductor 64 of the ring by bolts 123; a notch 131 is provided to pass a connection 126 through it which is fixed on the lower end of the conductor 112.

A cylindrical insulating screen 124 electrically insulates the conductors 112 and 62 and another cylindrical screen 125 insulates the conductors 62 and 61.

The conductor 112 is installed by its lower end while the conductor 61 is installed by its upper end. The lower insulating cylinders 124 and 125 bear on the connections 126 and 122 respectively.

If it is required to measure the currents in the conductors 80 (FIG. 4) or 94 (FIG. 5), it is necessary only to place magnetic circuits and secondary windings round the corresponding tubes 81 and 90 respectively.

If necessary, the magnetic circuits and the corresponding secondary windings can be placed round the tube 81 or round the tube 90 in the same insulation and shunt conditions as 14 or 15 to measure the current which flows through the corresponding conductors.

Figure 8:
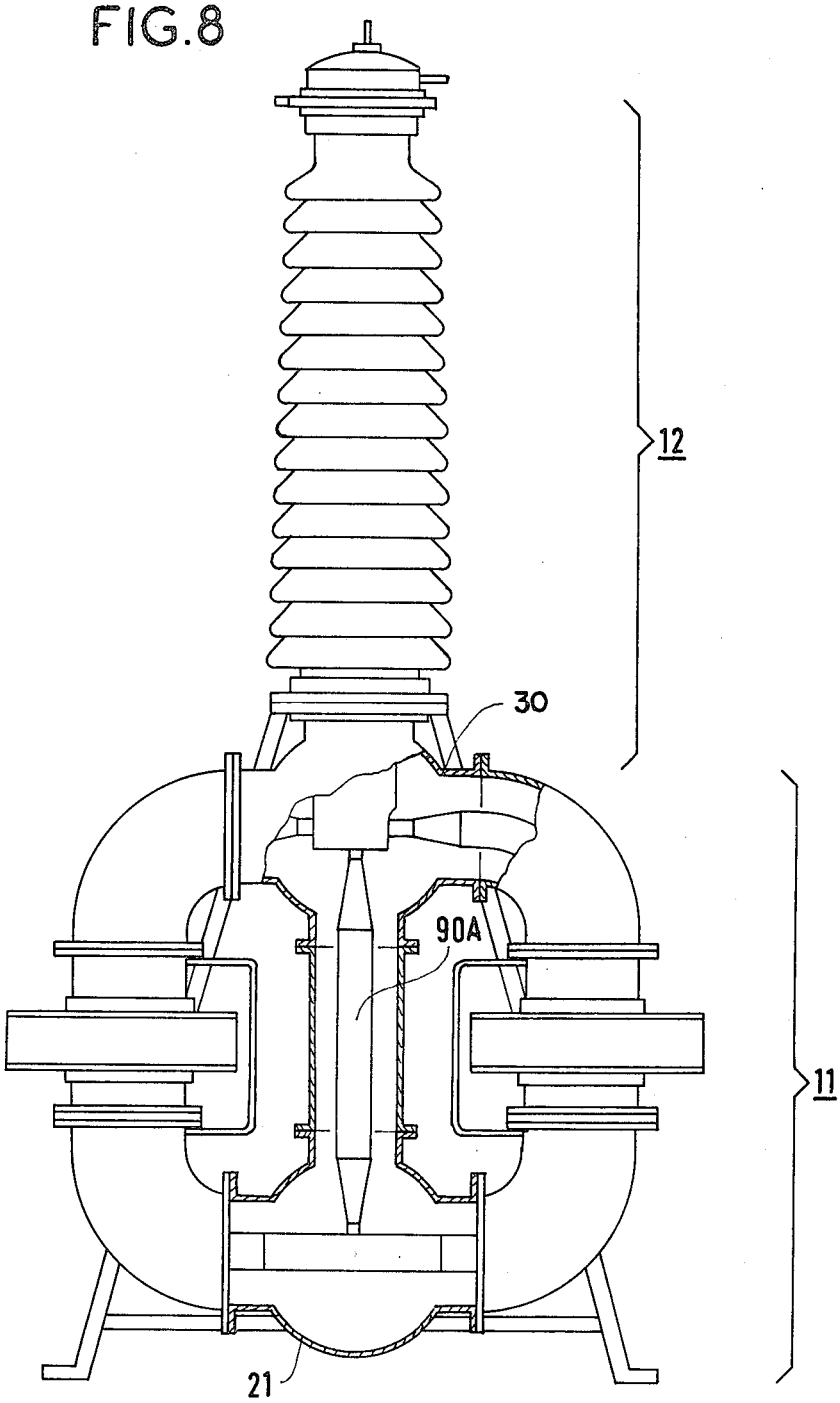
FIG. 8 is an elevation, partially cut-away, of a variant of the middle conductive portion of a transformer in accordance with the invention.

It is also possible to replace the conductor 90 and its U-shaped chamber 91 by a straight link 90A between the bottom of the cross-shaped connection component 80 and the top of the tube 21 as shown in FIG. 8. This makes the conductive ring-shaped portion and the annular chamber as a whole more rigid, the inspection ports then being shifted sideways.

The invention applies to equipping very high tension units.

I claim:

1. A current transformer with an insulating through bushing and an underlying annular metal chamber, said metal chamber having an upper portion and a lower portion, both said through bushing and said chamber being filled with compressed gas, a primary circuit with an input conductor which enters the metal chamber upper portion via the through bushing and an output conductor which leaves the metal chamber upper portion via the through bushing coaxially to the first conductor, and at least two magnetic circuits surrounding said metal chamber, each magnetic circuit having a secondary winding, and wherein the current transformer has an electric side connection emanating at said lower portion of said metal chamber, said electric side connection comprising a tube having ends connected respectively to said upper and lower metal chamber portions with its ends opening to the interior of said annular metal chamber, and a side connection conductor positioned within said tube, spaced therefrom and extending coaxially thereof to form with said tube, a gas insulated side connection cable, and wherein said magnetic circuits are disposed on either side of said side connection, such the current initially entering via said input conductor divides within said metal chamber into two circuits, one of which exits through said conductor via said through bushing and the other of which exits through said side connection conductor and wherein said side connection conductor is disposed in the insulating through bushing coaxially to the input conductor and the output conductor of the primary circuit such that the transformer functions as a double transformer, saving one insulating through bushing, and wherein the current as measured by the two secondary windings is sufficient to determine the current flowing through said input, said output and said side connection conductors.

2. A transformer according to claim 1, wherein the side connected is U-shaped.

3. A transformer according to claim 1, wherein the side connection is straight and is in line with the through bushing.

* * * * *